US007229952B2

(12) United States Patent
Reddy et al.

(10) Patent No.: US 7,229,952 B2
(45) Date of Patent: Jun. 12, 2007

(54) ADDITIVE PACKAGES FOR REMOVING OIL FROM SOLID MATERIALS RECOVERED FROM A WELL BORE

(75) Inventors: B. Raghava Reddy, Duncan, OK (US); Sears T. Dealy, Comanche, OK (US); Ian D. Robb, Duncan, OK (US)

(73) Assignee: Halliburton Energy Services, Inc., Duncan, OK (US)

( * ) Notice: Subject to any disclaimer, the term of this patent is extended or adjusted under 35 U.S.C. 154(b) by 397 days.

(21) Appl. No.: 10/874,977

(22) Filed: Jun. 23, 2004

(65) Prior Publication Data

US 2004/0235673 A1 Nov. 25, 2004

Related U.S. Application Data

(62) Division of application No. 10/325,762, filed on Dec. 19, 2002, now Pat. No. 6,846,420.

(51) Int. Cl.
*C11D 3/30* (2006.01)

(52) U.S. Cl. ..... 510/109; 134/25.1; 134/40; 175/66; 210/710; 210/728; 510/188; 510/380; 510/406

(58) Field of Classification Search ..... 210/708
See application file for complete search history.

(56) References Cited

U.S. PATENT DOCUMENTS

| | | | | |
|---|---|---|---|---|
| 3,510,520 | A * | 5/1970 | Graefe | 528/424 |
| 3,716,480 | A | 2/1973 | Finley et al. | 210/22 |
| 3,737,037 | A | 6/1973 | Bone, III | 210/73 |
| 4,599,117 | A | 7/1986 | Luxemborg | 134/25.1 |
| 4,645,608 | A | 2/1987 | Rayborn | 252/8.51 |
| 4,938,876 | A | 7/1990 | Ohsol | 210/706 |
| 5,090,498 | A | 2/1992 | Hamill | 175/206 |
| 5,204,452 | A | 4/1993 | Dingilian et al. | 530/420 |
| 5,271,463 | A | 12/1993 | Jennings, Jr. | 166/271 |
| 5,336,415 | A | 8/1994 | Deams | 210/725 |
| 5,362,717 | A | 11/1994 | Dingilian et al. | 514/55 |
| 5,582,118 | A | 12/1996 | Atkins et al. | 110/346 |
| 5,914,040 | A * | 6/1999 | Pescher et al. | 210/638 |
| 6,059,977 | A | 5/2000 | Rowney et al. | 210/710 |
| 6,179,071 | B1 | 1/2001 | Dietzen | 175/66 |
| 6,267,893 | B1 | 7/2001 | Luxemburg | 210/723 |
| 6,716,970 | B2 * | 4/2004 | Hung et al. | 536/20 |
| 6,764,981 | B1 * | 7/2004 | Eoff et al. | 507/110 |
| 6,802,416 | B1 * | 10/2004 | D'Alessio et al. | 206/229 |
| 6,827,874 | B2 * | 12/2004 | Souter et al. | 252/181 |
| 6,846,420 | B2 * | 1/2005 | Reddy et al. | 210/710 |
| 6,858,093 | B2 * | 2/2005 | Albu et al. | 134/38 |
| 7,115,547 | B2 * | 10/2006 | Madachik, Jr. | 507/261 |

FOREIGN PATENT DOCUMENTS

| | | |
|---|---|---|
| EP | 0 084 411 B1 | 9/1985 |

* cited by examiner

*Primary Examiner*—Peter A. Hruskoci
(74) *Attorney, Agent, or Firm*—Craig W. Roddy; Conley Rose, P.C.

(57) ABSTRACT

An additive package for removing oil from solid material recovered from a well bore, e.g., drill cuttings and produced sand, is provided. The additive package includes an aqueous acidic solution containing a polymer substituted with an amino group, a halogenating agent, and optionally one or more surfactants. The polymer substituted with an amino group is preferably chitosan, and the halogenating agent is preferably a sodium hypochlorite solution. A product of the reaction of the polymer and the halogenating agent, in conjunction with the surfactant when present, is capable of causing the separation of at least a portion of the oil from the solid material.

18 Claims, No Drawings

ADDITIVE PACKAGES FOR REMOVING OIL FROM SOLID MATERIALS RECOVERED FROM A WELL BORE

CROSS-REFERENCE TO RELATED APPLICATIONS

This is a Divisional Application of U.S. patent application Ser. No. 10/325,762, filed Dec 19, 2002. now U.S. Pat. No. 6,846,420, issued on Jan. 25, 2005 and entitled "A Process For Removing Oil From Solid Materials Recovered From A Well Bore."

FIELD OF THE INVENTION

This invention generally relates to oil/gas well drilling, cementing and production operations. More specifically, the invention relates to additive packages for removing oil from solid materials such as drill cuttings and sand recovered from a well bore.

BACKGROUND OF THE INVENTION

Well drilling is a process used in penetrating subterranean zones (also known as subterranean formations) that produce oil and gas. In well drilling, a well bore is drilled while a drilling fluid (also known as a drilling mud) is circulated through the well bore. The circulation of the drilling fluid is then terminated, and a string of pipe, e.g., casing, is run in the well bore. The drilling fluid in the well bore is conditioned by circulating it downwardly through the interior of the pipe and upwardly through the annulus, which is located between the exterior of the pipe and the walls of the well bore. Next, primary cementing is typically performed whereby a slurry of cement in water is placed in the annulus and permitted to set into a hard mass to thereby attach the string of pipe to the walls of the well bore and seal the annulus.

Drilling through subterranean zones containing clay and shales which swell upon exposure to water requires the use of non-aqueous drilling fluids to avoid problems such as sloughing and well collapse. Such non-aqueous fluids include a base fluid, e.g., diesel, mineral oil, unsaturated olefins, organic esters, or a combination thereof. Other components, such as calcium chloride brine, emulsifying surfactants, rheology modifiers, and wetting agents, are added to the base fluid such that the resulting water-in-oil emulsion, also referred to as an invert emulsion, may contain up to about 30-40 weight % internal aqueous phase based on the weight of the emulsion. The symbol "%" represents the term "percent" throughout this application.

During the drilling process, the drill bit generates drill cuttings as it forms the well bore. Drill cuttings consist of small pieces of shale and rock. The drill cuttings are carried in a return flow stream of the drilling fluid back to the well drilling platform. They are then separated from the bulk of the drilling fluid via conventional separators such as shale shakers, mud cleaners, and centrifuges. Some shale shakers filter coarse material from the drilling fluid while other shale shakers remove finer particles from the drilling fluid. After removing the drill cuttings therefrom, the drilling fluid may be re-used in the drilling process.

The drill cuttings separated from the bulk drilling fluid typically are discharged from the drilling platform to the surrounding area. Drilling platforms are often located offshore in hundreds of feet of water filled with marine life. The drill cuttings thus accumulate in the seabed near the base of the platform. Unfortunately, the drill cuttings collected from drilling with non-aqueous drilling fluids are contaminated with the oily organic drilling fluid. This oil must be removed from the drill cuttings before their disposal. Otherwise, the oil would pollute the surrounding environment and would be particularly hazardous to marine life.

The crude oil recovered from the subterranean formations often contains sand that must be separated from the oil. Like the drill cuttings, the sand is disposed of by dumping it from the drilling platform into the seabed where it forms sand piles. The sand also may be undesirably coated with the produced crude oil. Thus, the sand could adversely affect the marine environment unless the oil is removed therefrom.

Several methods have been used to remove oil from drill cuttings and sand to meet certain regulations designed to protect the environment from oil pollution. In one method, the oil is extracted using solvents such as toluene or methylene chloride. However, the potential hazards caused by the toxic nature of the solvents have raised doubts about this method. Another method involves transporting the drill cuttings and the sand onshore and subjecting them to a thermal process. For example, the oil is commonly burned off using very high temperature heat lamps or steam. Using such a thermal process can be very expensive, particularly since it is necessary to transport the drill cuttings and the sand to an onshore location.

As such, there continues to be a need for improved processes that utilize environmentally friendly, economical, and simple means for reducing the oil level in well bores, drill cuttings, and sand. The present invention utilizes a non-hazardous and simple process to remove oil contamination from solid materials, thus allowing for the drill cuttings and the sand to be inexpensively disposed of onsite, e.g., at the drilling platform.

SUMMARY OF THE INVENTION

Additive packages for removing oil from a solid material recovered from a well bore include a solution comprising a polymer substituted with an amino group and a halogenating agent. In an embodiment, the additive package further comprises one or more surfactants. The polymer is preferably chitosan, and the halogenating agent is preferably a sodium hypochlorite solution. A product of the reaction of the polymer and the halogenating agent, in conjunction with the surfactant when present, is capable of causing the separation of at least a portion of the oil from the solid material.

DETAILED DESCRIPTION OF THE PREFERRED EMBODIMENTS

According to the present invention, a process for removing oil from a solid material comprises passing the solid material from a well bore to a separation zone, introducing water and a solution comprising a polymer substituted with an amino group to the separation zone, introducing a halogenating agent to the separation zone, adjusting the pH as needed, and forming a mixture thereof in the separation zone. The amount of the amino-substituted polymer introduced to the separation zone is preferably in the range of from about 0.3% to about 30% by weight of the solid material, and more preferably in the range of from about 0.5% to about 10% by weight of the solid material. The halogenating agent is introduced to the separation zone in an amount effective to achieve from about 30% to about 100% conversion of the amino-substituted polymer. Optionally, one or more surfactants may also be introduced into the separation zone. The amount of the surfactant introduced to the separation zone is preferably in the range of from about 0.1% to about 20% by weight of the solid material, more preferably in the range of from about 2% to about 15% by weight of the solid material, and most preferably in the range of from about 3% to about 10% by weight of the solid material. Preferably, fresh water is introduced into the separation zone in an amount to provide a total volume of liquid components (i.e., water, surfactant, amino-substituted polymer, and halogenating agent) sufficient to thoroughly wet, and preferably submerge, the solid material present in the separation zone.

The separation zone may comprise any suitable array of processing equipment for combining the components as described herein, such as vessels, tanks, mixers, conveyors, and combinations thereof. The separation zone is preferably disposed within a settling tank. The components may be combined and mixed in any sequence yielding the desired results described herein. In an embodiment, the solid material is loaded into the separation zone, and the surfactant, the water, the amino-substituted polymer, and the halogenating agent are subsequently combined and mixed, preferably in the order indicated or in any suitable order. Preferably, the aqueous particle suspension formed prior to the addition of the halogenating agent is vigorously mixed. In another embodiment wherein a surfactant is not used, water is initially charged to the separation zone, to which the solid material, amino-substituted polymer, and halogenating agent are added. Alternatively, one or more surfactants may be added to the water along with the other components. In another embodiment, the surfactant is preferably applied directly to the solid material (for example, coating the solid material by spraying or mixing), and sufficient time is allowed to let the surfactants penetrate the oily coating. Water is then added to the solid material with vigorous mixing, followed by the addition of the amino-substituted polymer and the halogenating agent with additional stirring. The pH of the final mixture is adjusted by the addition of suitable acids or bases such that the pH is in a range of from about 3 to about 7. Suitable operating conditions for the separation zone, e.g., temperature and pressure, would be obvious to those skilled in the art Upon addition of all of the components, the mixture formed in the separation zone is preferably agitated while the amino-substituted polymer reacts with the halogenating agent, thus ensuring that the product of the reaction (i.e., an aminohalide polymer) is formed in intimate contact with the solid material. The mixture is then allowed to stand for a period of time sufficient to remove at least a portion of the oil from the solid material. For example, depending on the halogenating agent used, the mixture may be allowed to stand for a period sufficient to allow the newly formed solid to complete the process of suspension. Three phases form as a result of this process: an aqueous phase that is substantially free of the oil; a first solid phase containing the solid material having a reduced amount of oil thereon; and a second solid phase containing polymer solids and the oil removed from the solid material. The first solid phase settles to the bottom of the aqueous phase, and the second solid phase floats near the top of the aqueous phase. The amount of oil present in the first solid phase desirably meets government regulations, thus allowing the first solid phase to be disposed of onsite. The first solid phase preferably contains no greater than about 8% oil based on the weight of the solid material, more preferably no greater than about 3% oil, and most preferably no greater than about 1% oil.

Without limiting the scope of the present invention, it is theorized that the oil is removed from the solid material via the formation of the second solid phase, which comprises the haloamino polymer product of the amino-substituted polymer reacted with the halogenating agent. In particular, it is believed that the particles of the second solid phase use the droplets of the oil as a point to grow on (i.e., a nucleation site) such that the second solid phase forms around those droplets. In this manner, the oil droplets become trapped and encapsulated within the second solid phase, which, having a lesser density than water, floats at or near the surface of the aqueous phase.

The aqueous phase, the first solid phase, and the second solid phase may be separated using any known separation methods. For example, the second solid phase may be skimmed from the top of the aqueous phase, followed by decanting the aqueous phase, thereby leaving behind the first solid phase in a wet state. The second solid phase, which contains the removed oil and the haloamino polymer is significantly smaller in volume than the solid material originally recovered from the well bore. It can be disposed of using known disposal techniques, e.g., by incineration, without risking the contamination of the environment. The first solid phase may be disposed of in a landfill or disposed overboard.

The present invention further contemplates an additive package for removing oil from a solid material. The additive package includes a solution comprising a polymer substituted with an amino group, a halogenating agent, and optionally one or more surfactants, in relative amounts as described herein. In an embodiment, the components of the additive package can be stored separately until it is desirable to perform the process described above. As described previously, a product of a reaction of the polymer and the halogenating agent is capable of causing the separation of at least a portion of the oil from the solid material.

The aforementioned solid material may be any material recovered from a well bore and having oil disposed thereon. Examples of solid materials to which the process of the present invention may be applied are drill cuttings carried from a well bore via a stream of drilling fluid and sand carried from a well bore via a stream of crude oil. Before carrying out the oil removal process of the present invention, conventional separation techniques could be used to separate the drill cuttings from the bulk drilling fluid or the sand from the bulk crude oil.

Any suitable amino-substituted polymer or combination of amino-substituted polymers effective for forming a haloamino polymer for removal of oil from the solid material may be used in carrying out the invention. Examples of such amino-substituted polymers include polyvinylamine, polyethylenimine, polylysine, polymyxin, and chitosan. In a preferred embodiment, the amino-substituted polymer is chitosan. Chitosan is derived from chitin, which is a naturally-occurring polymer of beta-1,4-(2-deoxy-2-acetamidoglucose). Chitin is a primary constituent of the supporting tissues and exoskeletons of anthropods and insects and the cell walls of many fungi. Living organisms, particularly sea crustacea such as crabs, shrimps, and lobsters, produce millions of tons of chitin every year. Chitosan is derived from chitin by hydrolysis of some 2-deoxy-2-acetamidoglucose units to 2-deoxy-2-aminoglucose units. The term chitosan generally refers to copolymers having greater than 65% 2-deoxy-2-aminoglucose monomeric units, with the remainder monomeric units being 2-deoxy-2-acetamidoglucose units. The amount of the chitosan introduced to the separation zone preferably ranges from about 0.3% to about 10% by weight of the solid material. The chitosan preferably is dissolved in an aqueous acidic solution before introducing it to the separation zone. A preferred aqueous acidic solution comprises no more than about 1% acetic acid based on the combined weight of the acetic acid and the water. A preferred chitosan solution is poly N-acetylglucosamine, which is at least 65% deacetylated, dissolved in an acetic acid solution. The chitosan is present in the aqueous acidic solution as a polycation with the protonated amino group bearing a positive charge. The protonated amino group becomes less polar when it bonds with the halogen provided by the halogenating agent. Alternatively, chitosan in the solid form may be purchased from Vanson Company of Redmond, Wash., U.S.A. under the tradename KLARIFY 101. As a result of the reaction of the chitosan with the halogenating agent, at least a portion of the 2-deoxy-2-aminoglucose monomeric units of the chitosan are converted to 2-mono or 2,2-dihalo aminoglucose monomeric units to yield a new polymer known as N-halochitosan. To optimize the rate of reaction and to minimize the decomposition of the N-halochitosan product, the separation zone is maintained at a temperature preferably in the range of from about 0° C. to about 80° C., and more preferably in the range of from about 15° C. to about 30° C. Additional disclosure regarding the preparation of N-halochitosans can be found in U.S. Pat. No. 5,362,717; and U.S. Pat. No. 5,204,452, which are incorporated herein in their entirety.

In alternative embodiments, the amino-substituted polymer is polyethylenimine. This polymer is obtained by polymerizing aziridine, resulting in the formation of branched polyethylenimine. Non-branched polyethylenimine may also be used in the present invention. When polyethylenimine solution in water is used, it is preferably reacted with the halogenating agent prior to the adjustment of pH to prevent the precipitation of the former at acidic pH.

Any suitable halogenating agent or combination of halogenating agents effective for reacting with and halogenating the amino-substituted polymer to form a haloamino polymer may be used in carrying out the invention. Examples of compounds that may be employed as the halogenating agent include but are not limited to sodium hypochlorite, calcium hypochlorite, chlorine, bromine, N-chlorosuccinimide, sodium hypobromite, pyridinium bromide perbromide, N-bromosuccinimide, chloramine-T, and combinations thereof. In preferred embodiments, the halogenating agent is sodium hypochlorite, which is readily available and relatively inexpensive. The sodium hypochlorite is preferably introduced to the separation zone in an aqueous solution. When sodium hypochlorite is reacted with chitosan to form N-halochitosan, the reaction is usually complete in less than about 10 minutes. Less reactive halogenating agents such as N-bromosuccinimide may require about 30 to 60 minutes, or even longer depending on the temperature, to complete the reaction.

Any suitable surfactant or combination of surfactants effective for promoting the removal of oil from the solid material may be used in carrying out the invention. The surfactants may be nonionic, anionic or cationic. However, non-ionic surfactants are preferred. The ability of a surfactant to emulsify two immiscible fluids, such as oil and water, is often described in terms of hydrophile-Lipophile balance (HLB) values. These values, ranging from 0 to 40, are indicative of the emulsification behavior of a surfactant and are related to the balance between hydrophilic and lipophilic portions of the molecules. In general, surfactants with higher HLB values are more hydrophilic than those with lower HLB values. As such, they are generally more soluble in water and are used in applications where water constitutes the major or external phase and a less polar organic fluid constitutes the minor or internal phase. Thus, for example, surfactants with HLB values in the range 3-6 are suitable for producing water-in-oil emulsions, whereas those with HLB values in the 8-18 range are suitable for producing oil-in-water emulsions. A commonly used formula for calculating HLB values for nonionic surfactants is as follows: $HLB=20\times M_H/(M_H+M_L)$, where $M_H$ is the formula weight of the hydrophilic portion of the molecule and $M_L$ is the formula weight of the lipophilic portion of the molecule. When mixtures of surfactants are used, the overall HLB values for the mixture are calculated by summing the HLB contributions from different surfactants as shown in equation below: $HLB=(\acute{o}_1\times HLB_1+\acute{o}_2\times HLB_2+\ldots+\ldots \text{ etc.})$, where $\acute{o}_1$ is the weight fraction of surfactant #1 in the total mixture, $HLB_1$ is the calculated HLB value of surfactant #1, $\acute{o}_2$ is the weight fraction of surfactant #2 in the total surfactant mixture, and $HLB_2$ is the calculated HLB value of the surfactant #2, and so on.

It has been observed that a mixture of a preferentially oil-soluble surfactant and a preferentially water-soluble surfactant provides better and more stable emulsions. As such, these types of mixtures are preferred in the present invention to further reduce the oil-content on the solid particles. In particular, non-ionic ethoxylated surfactant mixtures containing from about 3 to about 12 moles of ethylene oxide, exemplified by nonylphenol ethoxylates containing from about 4 moles to about 10.5 moles of ethylene oxide are preferred. The HLB ratio for a single surfactant or a surfactant mixture employed in the present invention preferably ranges from about 7 to about 16, more preferably from about 8 to about 15.

EXAMPLES

The invention having been generally described, the following examples are given as particular embodiments of the invention and to demonstrate the practice and advantages hereof. It is understood that the examples are given by way of illustration and are not intended to limit the specification or the claims to follow in any manner.

Comparative Example 1

A sample of a base oil used in a drilling fluid commercially available from Halliburton, Inc. under the tradename ACCOLADE™ was obtained. A milliliter of the oil was added to 100 milliliters (mL) of tap water, emulsified with high speed agitation for 1 minute, and set aside for 15 minutes. An identical emulsion was prepared in a separate beaker and to this emulsion, 10 mL of a 1 weight (wt.) % solution of chitosan prepared in a 1 wt. % acetic acid solution was added, stirred, and set aside. A third batch of identical emulsion was prepared and 10 mL of the 1 wt. % chitosan solution was added while stirring, followed by adding 10 mL of sodium hypochlorite solution (5 wt. % sodium hypochlorite solution is typically sold as household bleach). In 15-30 minutes, the beaker containing chitosan and bleach solution contained white flocculated solid floating on completely clear water. The other two beakers contained uniform milky emulsions. The milky emulsions were stable and did not show any signs of separation even after 48 hours. The beaker containing the flocculated solid was filtered, followed by drying the solid at room temperature. A thermal gravimetric analyses (TGA) of the dried solid and of a sample of the oil was taken using a Hi-Res TGA 2950 Thermogravimetric Analyser manufactured by TA Instruments of New Castle, Del., U.S.A. The TGA showed that the filtered flocculated solid contained the oil used in the emulsion.

Comparative Example 2

An emulsion identical to the one described in Comparative Example 1 was prepared in 100 mL of water. Enough polyethylenimine concentrate (33 wt. % solution) was added to the emulsion with stirring, followed by adding 10 mL of sodium hypochlorite solution to the emulsion and setting the resulting mixture aside. An identical mixture was prepared in a separate beaker, and the pH of the mixture was lowered to 5.5 with glacial acetic acid. After about 18 hours, the beaker containing the emulsion mixture at a lower pH showed flocculated solid floating in water, whereas the beaker containing emulsion mixture at a higher pH did not show any tendency to form flocculated solid.

Example 1

A 20/40 mesh (U.S. Series) graded sand was contacted with ACCOLADE™ drilling fluid for several hours, followed by physically separating the sand from the drilling fluid. A sample of the sand, which was coated with the drilling fluid when tested by the TGA method, was found to contain 10.3% volatiles by weight of the sand in the 25° C. to 500° C. range.

Another 1 gram sample of the sand contacted with the ACCOLADE™ drilling fluid was suspended in 100 mL of water and vigorously agitated for one minute. A 10 mL sample of 1 wt. % chitosan solution in a 1 wt. % acetic acid solution was added while stirring, followed by adding 10 mL of a bleach solution containing 5 wt. % sodium hypochlorite to induce the removal of oil from the sand sample. After the oil in the sand sample had been removed, the sand sample was collected by decantation. TGA analysis of the collected sand showed that all the volatiles from the drilling fluid had been removed by the treatment.

During the oil removal process, a suspended solid phase containing the oil removed from the sand sample was formed. The suspended solid phase was tested by TGA to determine the amount of oil present in the suspended solid phase. The results showed that the suspended solid contained 56% by total weight of the oil removed from the sand. This amount accounts approximately for all the volatiles removed from the sand.

Comparative Example 3

A field sample of cuttings collected during drilling in the Chesapeake area using a typical diesel based drilling fluid was obtained for use as a control sample. The control sample was then analyzed by TGA. As indicated in Table 1 below, the TGA showed 15.3% volatiles by weight of the cuttings in the 75-200° F. range and 17.3% volatiles by weight of the cuttings in the 75-475° F. range.

Examples 2-9

In Example 2, the procedure used was identical to that used in Example 1 with the exception of using a field sample of cuttings. In Examples 3 and 5-9, one or more surfactants were added directly to the drill cuttings, followed by the addition of water with vigorous stirring, followed by the addition of the chitosan solution and bleach solution as described in Example 1. In Example 4, Surfactant A was added to water, and the rest of the procedure was the same as described in Example 1. Surfactant A is a nonylphenol ethoxylate containing 4 moles of ethylene oxide (calculated HLB value=8.8), and Surfactant B is a nonylphenol ethoxylate containing 10.5 moles of ethylene oxide (calculated HLB value=13.6), both of which are available from Union Carbide Corporation as TERGITOL NP 4 and TERGITOL NP 10, respectively. Table 1 below shows the amount of each surfactant added to the drill cuttings.

After treatment, the drill cuttings were separated from the aqueous layer of the removed oil. Additional water was used to rinse the decanted cuttings. The cuttings were dried at room temperature and analyzed by TGA to determine the weight % of oil remaining after treatment. The results of the TGA analysis are also shown in Table 1. The volatile portion in the 75-200° F. range presented in Table 1 represents the base oil present in the drilling fluid. Any material volatilized in the 200-475° F. range represents the drilling fluid components, which are less volatile and typically consist of emulsifiers and calcium salts present in the internal aqueous phase. Such materials are not considered particularly hazardous compared to the base oil. In Table 1, the total volatile content of the treated cuttings in the 75-475° F. and in the 75-200° F. range are presented. A portion of the treated cuttings were lost in the suspended solid because of their extremely small particle sizes, which prevented their settling.

TABLE 1

| Example | Surfactant A (% by weight of cuttings) | Surfactant B (% by weight of cuttings | Surfactant Application Method | Wt. % Oil Residue (volatile portion between 75°–200° F.) | Wt. % Oil Reduction on the Cuttings | Wt. % Total Residue Volatized between 75° and 475° F. | Wt. % Total Volatile Reduction Due to Treatment |
|---|---|---|---|---|---|---|---|
| Control (Untreated) | — | — | — | 15.3 | — | 17.3 | — |
| 2 | None | None | None | 4.0 | 73 | 7.6 | 58 |
| 3 | 10 | None | Coat | 3.2 | 79 | 13.9 | 20 |
| 4 | 10 | None | Solution | 3.7 | 76 | 9.3 | 46 |
| 5 | None | 10 | Coat | 2.7 | 82 | 6.1 | 65 |
| 6 | 5 | 5 | Coat | 1.0 | 93 | 4.6 | 73 |
| 7 | 2.4 | 0.6 | Coat | 2.3 | 85 | 6.2 | 64 |
| 8 | 8 | 2 | Coat | 4.0 | 74 | 13.3 | 23 |
| 9 | 2 | 8 | Coat | 0.93 | 94 | 4.8 | 72 |

The data in Table 1 indicates that the oil content of the treated cuttings in Example 2 was reduced by 73 wt. % due to treatment with chitosan and bleach solution without using any surfactants. The overall reduction of the total volatile content of the treated cuttings in Example 2 was 58 wt. %. A comparison of the results from Examples 3 and 4 suggests that the surfactant can be applied either in solution form or as a pre-coat on the cuttings prior to treatment with chitosan and bleach solution. The results indicate slightly better performance in oil reduction (see volatile content loss in 75-200° F.) when the surfactant is applied as a pre-coat. The results from Example 5 suggest that using a surfactant with a higher HLB value, i.e., Surfactant B, is more effective in reducing both the oil content and the total volatile content when compared to Surfactant A in Example 3. The results from Examples 6-9 also show that using mixtures of the two surfactants is more effective than using each surfactant individually in similar or significantly reduced amounts.

While the preferred embodiments of the invention have been shown and described, modifications thereof can be made by one skilled in the art without departing from the spirit and teachings of the invention. The embodiments described herein are exemplary only, and are not intended to be limiting. Many variations and modifications of the invention disclosed herein are possible and are within the scope of the invention. Use of the term "optionally" with respect to any element of a claim is intended to mean that the subject element is required, or alternatively, is not required. Both alternatives are intended to be within the scope of the claim.

Accordingly, the scope of protection is not limited by the description set out above, but is only limited by the claims which follow, that scope including all equivalents of the subject matter of the claims. Each and every claim is incorporated into the specification as an embodiment of the present invention. Thus the claims are a further description and are an addition to the preferred embodiments of the present invention. The discussion of a reference herein is not an admission that it is prior art to the present invention, especially any reference that may have a publication date after the priority date of this application. The disclosures of all patents, patent applications, and publications cited herein are hereby incorporated by reference, to the extent that they provide exemplary, procedural or other details supplementary to those set forth herein.

What is claimed is:

1. A composition comprising:

(a) solid material recovered from a well bore; and (b) An additive package for removing oil from solid material recovered from a well bore, comprising:

(i) a solution comprising a polymer substituted with an amino group;

(ii) a halogenating agent, wherein a product of a reaction of the polymer and the halogenating agent is capable of causing a separation of at least a portion of the oil from the solid material; and (iii) a non-ionic surfactant mixture having HLB ratio in a range of from about 7 to about 16 including an oil soluble surfactant and a water soluble surfactant, to reduce oil content in said solid material.

2. The additive package of claim 1, wherein the polymer substituted with the amino group comprises polyvinylamine, polyethylenimine, polylysine, polymyxin, chitosan, or combinations thereof.

3. The additive package of claim 1, wherein the polymer substituted with the amino group comprises chitosan.

4. The additive package of claim 3, wherein the halogenating agent comprises a sodium hypochlorite solution.

5. The additive package of claim 4, wherein the polymer solution comprises acetic acid.

6. The additive package of claim 5, wherein said surfactant mixture comprises a nonyiphenol ethoxylate surfactant.

7. The additive package of claim 1, wherein the polymer substituted with the amino group comprises polyethylenimine.

8. The additive package of claim 1, wherein the solution comprises an acid.

9. The additive package of claim 8, wherein the acid comprises acetic acid.

10. The additive package of claim 1, wherein the halogenating agent comprises sodium hypochlorite, calcium hypochlorite, chlorine, bromine, N-chlorosuccinimide, sodium hypobromite, pyridinium bromide, perbromide, N-bromosuccinimide, chloramine-T, or combinations thereof.

11. The additive package of claim 1, wherein the halogenating agent comprises a sodium hypochlorite solution.

12. The additive package of claim 1, wherein the non-ionic surfactant mixture comprises a non-ionic ethoxylated surfactant having from about 3 moles to about 12 moles of ethylene oxide.

13. The additive package of claim 12, wherein the non-ionic ethoxylated surfactant mixture further comprises one or more nonylphenol ethoxylates having from about 4 moles to about 10.5 moles of the ethylene oxide.

14. The additive package of claim 1, wherein the solid material comprises drill cuttings, sand, or combinations thereof.

15. The additive package of claim 1, wherein an amount of the polymer is in a range of from about 0.3% to about 30% by weight of the solid material.

16. The additive package of claim 1, wherein an amount of the polymer is in a range of from about 0.5% to about 10% by weight of the solid material.

17. The additive package of claim 1, wherein an amount of the halogenating agent is effective to achieve from about 30% to about 100% conversion of the polymer.

18. The additive package of claim 1, wherein an amount of the surfactant mixture is in a range of from about 0.1% to about 20% by weight of the solid material.

* * * * *

UNITED STATES PATENT AND TRADEMARK OFFICE

CERTIFICATE OF CORRECTION

PATENT NO. : 7,229,952 B2
APPLICATION NO. : 10/874977
DATED : July 23, 2004
INVENTOR(S) : B. Raghave Reddy et al.

It is certified that error appears in the above-identified patent and that said Letters Patent is hereby corrected as shown below:

Col. 9, lines 46-48, delete "A composition comprising:
(a) solid material recovered from a well bore; and
(b)"

Claim 1, Col. 10, line1, replace "HLB" with -- a HLB --

Signed and Sealed this

Fourth Day of September, 2007

JON W. DUDAS
*Director of the United States Patent and Trademark Office*

UNITED STATES PATENT AND TRADEMARK OFFICE

CERTIFICATE OF CORRECTION

PATENT NO. : 7,229,952 B2
APPLICATION NO. : 10/874977
DATED : June 12, 2007
INVENTOR(S) : B. Raghave Reddy et al.

It is certified that error appears in the above-identified patent and that said Letters Patent is hereby corrected as shown below:

Col. 9, lines 46-48, delete "A composition comprising:
(a) solid material recovered from a well bore; and
(b)"

Claim 1, Col. 10, line1, replace "HLB" with -- a HLB --

This certificate supersedes Certificate of Correction issued September 4, 2007.

Signed and Sealed this

Ninth Day of October, 2007

JON W. DUDAS
*Director of the United States Patent and Trademark Office*